US006915793B2

(12) United States Patent
Vanek et al.

(10) Patent No.: US 6,915,793 B2
(45) Date of Patent: Jul. 12, 2005

(54) MOTORIZED MULTI-SHOT TOY RING AIRFOIL LAUNCHER

(76) Inventors: Chester F. Vanek, 1171 Redrock Ct., Sunnyvale, CA (US) 94089; Abraham Flatau, 3330 Vernon Ter., Palo Alto, CA (US) 94303

( * ) Notice: Subject to any disclaimer, the term of this patent is extended or adjusted under 35 U.S.C. 154(b) by 385 days.

(21) Appl. No.: 10/229,184

(22) Filed: Aug. 26, 2002

(65) Prior Publication Data

US 2003/0051719 A1 Mar. 20, 2003

Related U.S. Application Data

(60) Provisional application No. 60/315,966, filed on Aug. 29, 2001.

(51) Int. Cl.[7] ..... F41B 4/00
(52) U.S. Cl. ..... 124/78
(58) Field of Search ..... 124/6, 78, 81, 124/82

(56) References Cited

U.S. PATENT DOCUMENTS 5,970,970 A 10/1999 Vanek et al.
5,996,564 A * 12/1999 Kotowski ..... 124/6
6,024,078 A * 2/2000 Hollis et al. ..... 124/78
6,079,398 A * 6/2000 Grimm ..... 124/81 X
6,523,535 B2 * 2/2003 Rehkemper et al. ..... 124/78

* cited by examiner

*Primary Examiner*—John A. Ricci
(74) *Attorney, Agent, or Firm*—Weide & Miller, Ltd.

(57) ABSTRACT

A launcher is configured to launch a plurality of ring airfoil projectiles. The launcher includes a body defining a launch passage. Ring airfoil projectiles are mounted on a magazine loaded into a first end of the passage. Movement of a trigger causes the magazine to be moved forward in the passage into engagement with a drive element, such as a pair of drive disks. Movement of the trigger also causes the drive element to be driven, and when engaged with a ring airfoil projectile on the magazine, to be launched from the second end of the passage. In one embodiment, the drive disks are driven by an electric motor and impart both a propelling and spinning force upon the ring airfoil projectile. Multiple ring airfoil projectiles may be loaded on the magazine and launched in succession without the need to reload.

20 Claims, 6 Drawing Sheets

MOTORIZED MULTI-SHOT TOY RING AIRFOIL LAUNCHER

RELATED APPLICATION DATA

This application claims priority to U.S. Provisional Application Ser. No. 60/315,966, filed Aug. 29, 2001.

FIELD OF THE INVENTION

The present invention relates to toy guns and, more particularly, to a toy which is capable of successively launching a series of ring airfoil projectiles or conventionally designed ballistic shaped projectiles.

BACKGROUND OF THE INVENTION

Toys which launch projectiles are extremely popular. These toys include guns which launch ping-pong type balls, bb's, flat discs, darts and similar items. Generally, these toys must satisfy a variety of criteria in order to be successful. First and foremost, the toy must be safe. For a toy gun to be popular, however, it must also be effective in launching projectiles over long distances and with accuracy. A significant problem with many toy guns or other launchers is that their projectiles do not travel straight and do not travel far.

The ring airfoil is an aeroballistic device capable of flying extended distances due to the generation of lift in flight. As illustrated in FIGS. 1A and 1B, the ring airfoil is shaped like an airplane wing coiled around into a ring-shape. Like a bullet, the ring airfoil is self-trimmed, given a spin in flight which stabilizes its orientation and enables it to maintain a horizontally near straight trajectory. Unlike a bullet, however, the lift imparted to a flying ring airfoil begins to cancel gravitational force on the ring as the gravity induced curvature of the flight path increases the angle of attack. The cumulative result is that the ring airfoil generates lift and flies like a glider, but follows an accurate, near straight course in the absence of wind. Hence, the term "aeroballistic" denotes a self-trimmed, lift-generating object—a unique behavioral characteristic for flying objects, and one which has several uses.

One use is as a toy. The range of a toy ring airfoil is typically two to three times that of a simple ballistic toy having the same weight, velocity, and drag. Thus, the toy ring airfoil both fascinates and facilitates the out-ranging of competitors in a fantasy battle. Its accuracy and seemingly straight flight path give it a wide margin of ballistic superiority over all other trigger launched toy projectiles.

Recognition of these advantages was realized by the inventors herein who also invented the first successful toy ring airfoil launcher, the Vortex Tornado, subject to U.S. Pat. No. 5,970,970. This toy was a muzzle-loading device that showcased the capability of the ring airfoil toy.

It is desired, however, to improve upon this toy. Among other things, this toy permitted the launching of only a single airfoil projectile before needing to be reloaded. In addition, it is desired to improve upon the manner by which the projectiles are launched to improve their flight distance and the line of flight.

SUMMARY OF THE INVENTION

The invention is a device for launching ring airfoil projectiles or devices and a method of launching such devices. In a preferred embodiment, the device is capable of launching multiple ring airfoil devices in succession, the ring airfoil devices provided with both a forward propelling force and a stabilizing spin.

In one embodiment, the launcher comprises a body defining a launch passage having a first end and a second end. The launcher includes a magazine on which a plurality of ring airfoil projectiles may be located, the magazine configured to be inserted into the first end of launch passage. The launcher includes at least one drive element, at least a portion of the drive element engaging at one or more times a ring airfoil projectile on the magazine. A drive is adapted to rotate the drive element, whereby when the drive element contacts a ring airfoil projectile, the ring airfoil projectile is propelled forward off of the magazine through the launch passage towards the second end and is propelled from the launcher. The launcher includes a trigger movable from a first position to a second position, the trigger when moved to the second position causing the magazine to move forward so that the drive element engages the ring airfoil projectile.

In one embodiment, the launcher includes a magazine housing slidably positioned in the launch passage, the magazine connectable to the magazine housing for movement with the magazine housing. The magazine has a first end and a second end and means for biasing ring airfoil projectiles positioned thereon towards its first end. In one embodiment, this means comprises a bellows-type spring.

In one embodiment, at least one stop is provided for selectively preventing the ring airfoil projectiles from being removed from the first end of the magazine. In one embodiment, the at least one stop comprises a first detent extending from a pivoting member, the pivoting member movable from a first position, in which the first detent extends outwardly to engage a ring airfoil projectile, and a second position, in which the first detent is pressed inwardly, permitting the ring airfoil projectile to move off of the first end of the magazine.

In one embodiment, the drive comprises a motor. The motor is arranged to drive the drive element by a connecting gear or pulley drive system.

In one embodiment, the drive element comprises a pair of drive disks, the drive disks configured to engage opposing sides of the ring airfoil projectile. In one embodiment, the drive disks are canted with respect to one another and to an axis extending through the launch passage, whereby the drive disks impart a spinning motion upon the ring airfoil projectile.

One embodiment of the invention comprises a method of launching ring airfoil projectiles. This method includes the step of loading at least a first and a second ring airfoil projectile on a magazine, the magazine having a first end and a second end. The method includes the step of inserting the first end of the magazine into a first end of a passage through the launcher, biasing the ring airfoil projectiles towards the first end of the magazine, and stopping the ring airfoil projectiles from being removed from the first end of the magazine. In response to a trigger input, the method includes the steps of moving the magazine forward towards the second end of the passage, rotating a pair of drive disks, releasing the first ring airfoil projectile from the magazine, stopping the second ring airfoil projectile on the magazine, engaging the rotating disks with the released first ring airfoil projectile, and propelling the first ring airfoil projectile from the second end of the passage.

Further objects, features, and advantages of the present invention over the prior art will become apparent from the detailed description of the drawings which follows, when considered with the attached figures.

DETAILED DESCRIPTION OF THE INVENTION

The invention is a device for launching multiple ring airfoil projectiles. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention is a device for launching multiple ring airfoil projectiles. The preferred use of the device is as a toy. In such a configuration, the maximum energy which may be transmitted by a launched ring airfoil is selected to reduce the probability of damage or injury to persons or property. Variables such as airfoil weight and launch velocity are thus considerations when configuring the device of the invention for use as a toy. In other configurations, the device may be used for purposes other than as a toy.

In one embodiment, the device is a launcher which includes a body including a launching mechanism. The launcher includes a magazine capable of holding or housing a plurality of ring airfoil projectiles. The magazine can be mated with the body of the launcher, permitting multiple ring airfoil projectiles to be launched in sequence in semi-automatic fashion without the need to load or re-load. In one embodiment, the launcher is referred to as "motorized" in that the launching mechanism comprises a motor or motor-driven device which effects the launching of the projectiles.

Figure 1A:
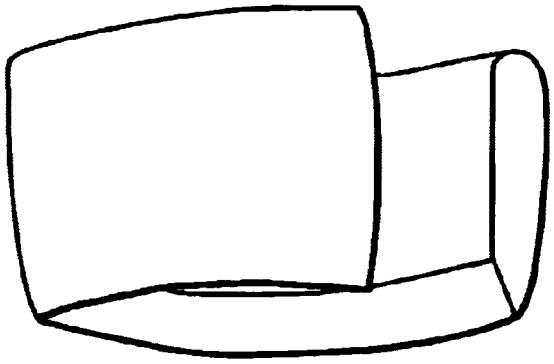
FIG. 1A is a perspective view of a ring airfoil of the type which may be launched with a launcher of the present invention.
Figure 1B:
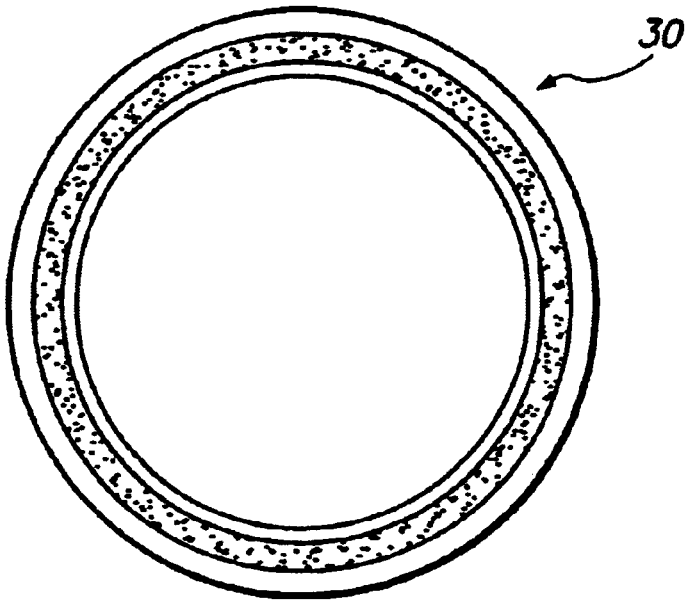
FIG. 1B is an end view of the ring airfoil taken in the direction of arrow 1B in FIG. 1A.
Figure 2:
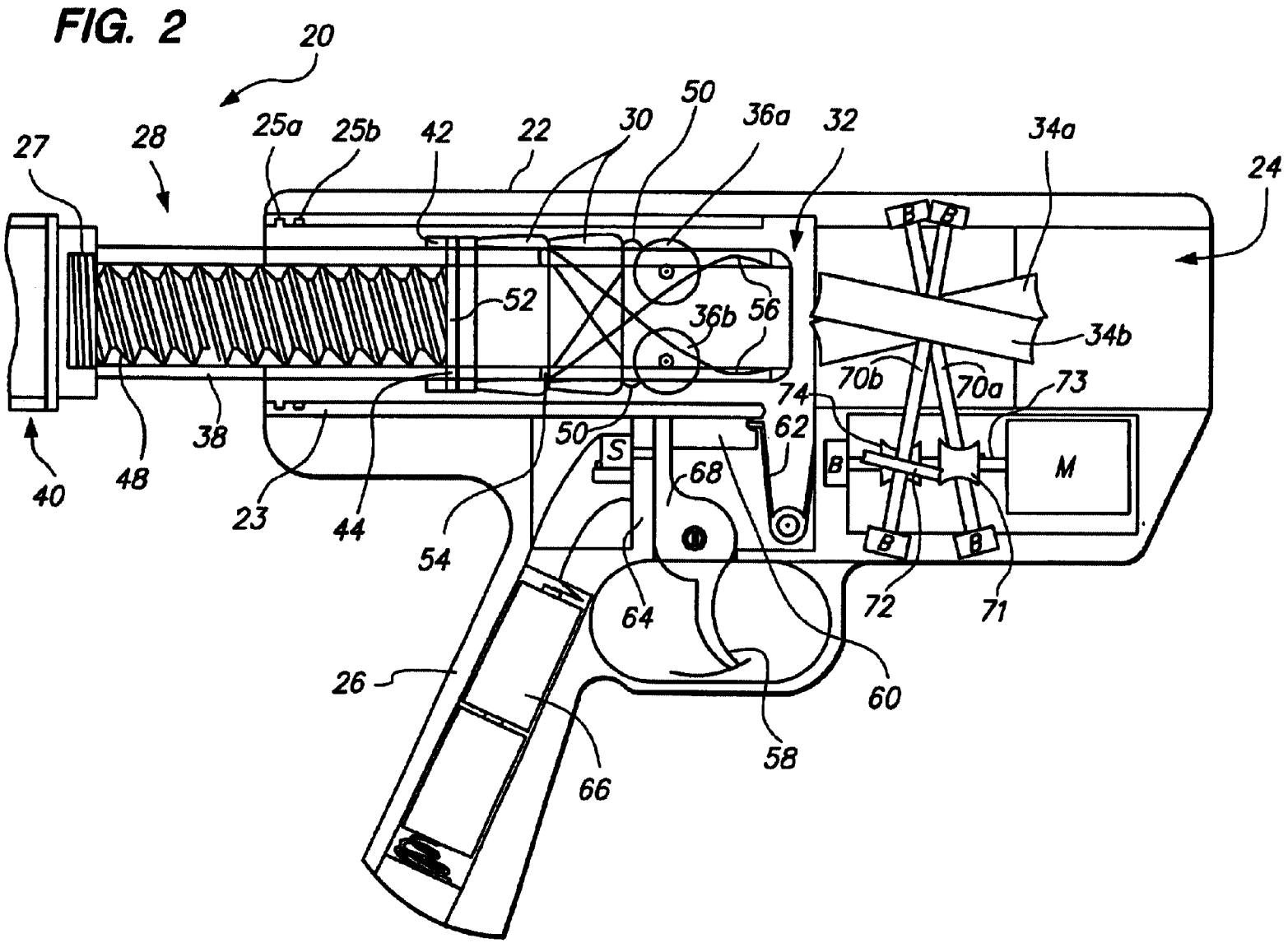
FIG. 2 is a cross-sectional side view of a launcher in accordance with one embodiment of the invention.

FIG. 2 illustrates one embodiment of a launcher 20 in partial section view. The launcher 20 includes a body or housing 22. Generally, the body 22 defines a tubular or cylindrical launch passage or barrel 24 there through. The launch passage 24 has a first end from which ring airfoil projectiles or devices are fired and an opposing second end through which they are loaded.

The body 22 also defines a downwardly extending grip, stock or handle 26. The launcher 20 further includes a magazine 28 for holding one or ring airfoil devices or projectiles (RADs) 30.

The launcher 20 includes means for moving or removing the RADs 30 from the magazine 28. The launcher 20 also includes means for launching a RAD 30 removed from the magazine 28 from the body 22 through the barrel 24.

The magazine 28 is illustrated holding two RADs 30, but may hold as few as one and more than two, such as three or more RADs 20. The magazine 28 is illustrated partially inserted into the launcher 20. A top view of the magazine 28 illustrated in its fully inserted position is provided in FIG. 3. As illustrated therein, when fully inserted, a front end 32 of the magazine 28 is located between a pair of drive disks 34*a,b*.

In one embodiment, the launcher 28 includes a magazine holder or housing 23. As illustrated in FIG. 2, the magazine holder 23 comprises a tubular or cylindrical member located in the passage 24 through the body 22 into which a loaded magazine 28 may be inserted.

Figure 3:
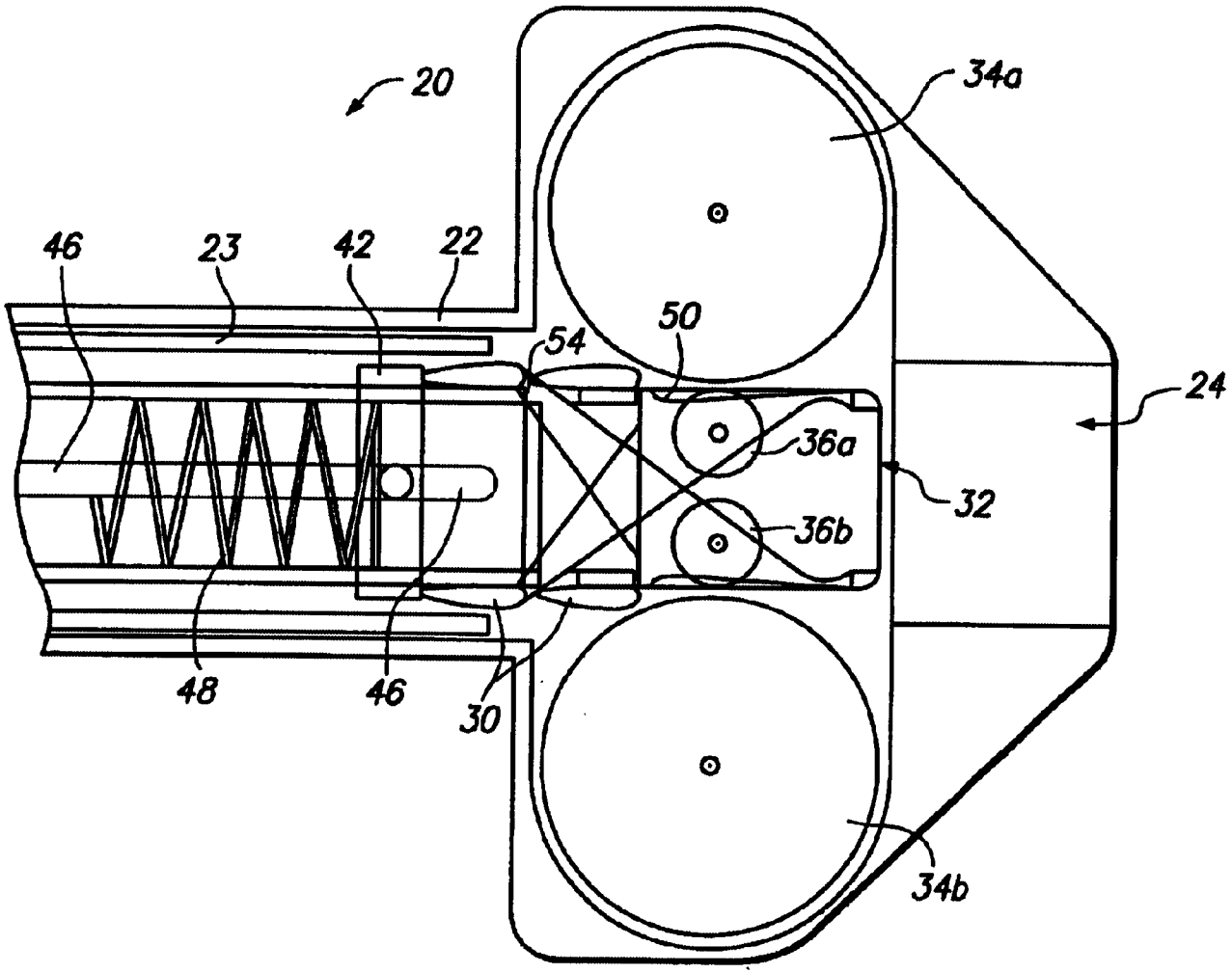
FIG. 3 is a cross-sectional top view of a portion of the launcher illustrated in FIG. 2.

In the embodiment illustrated, the means for locking the magazine 28 to the body 22 includes a pair of locking recesses 25*a,b* formed in the inner surface of the magazine holder 23. The means also includes a plurality of locking lugs 27 formed on the magazine 28 at the second end 40 thereof. In this embodiment, rotation of the magazine 28 relative to the magazine holder 23 by approximately 90 degrees places the lugs 27 into or out of engagement with the recesses 25*a,b*. When the lugs 27 are engaged with the recesses 25*a,b*, the magazine 28 is retained or locked in position. It will now be appreciated that FIG. 2 illustrates the magazine 28 in a position in which it is not fully inserted and not rotated for locking. FIG. 3 illustrates the magazine 28 fully inserted and rotated into its locked position, thus orienting the drive disks 34*a,b* and a pair of follower wheels 36*a,b* of the magazine 28.

Other means may be provided for selectively connecting the magazine 28 to the body 22 of the launcher 20. For example, the magazine 28 and body 22 or magazine holder 23 may be provided with mating threads, or a clip, clamp or the like.

In one embodiment of the invention, the magazine holder 23 is permitted to slide longitudinally a limited distance inside the body 22 of the launcher 20. It will be appreciated that when the magazine 28 is connected to the magazine holder 23, forward movement of the magazine holder also results in corresponding forward movement of the magazine 28.

Referring again to FIG. 2, the magazine 28 includes an elongate mount 38 in the form of a generally cylindrical tube upon which the RADs 30 may be located. As indicated above, RADs 30 are designed to be placed on the magazine 28 from the front end 32, and to be removed from the front end for launching. A second end 40 of the magazine 28 is formed as a stop.

Means are provided for biasing the RADs 30 to the first end 32 of the magazine 28. In one embodiment, this means includes a follower-ring 42 that surrounds the exterior of the magazine tube 38. The follower-ring 42 is designed to travel behind loaded RADs 30. In one embodiment, a rod 44 connects the follower-ring 42 to the magazine tube 38. As illustrated, the rod 44 extends through the hollow tube 38 of the magazine 38 and is mounted at each of its end to the follower-ring 42. In one embodiment, the rod 44 is designed to travel along the tube 38 in a slot 46 (see FIG. 3).

Means are provided for biasing the rod 44, and thus the follower-ring 42, towards the first end 34 of the magazine 28. In one embodiment, this means comprises a spring, and more preferably, a bellows-type spring 48. The spring 48 is mounted between the rod 44 and the second end 40 of the magazine 28. The spring 48 generates a force which pushes the follower-ring 42 and RADs 30 forward.

As indicated, in one embodiment, the spring 48 is a bellows spring. In this embodiment, the spring 48 may be constructed of flexible plastic and encloses a volume of air. A small orifice 52 provided through the rod 44 connects the interior of the spring 48 to ambient. The function of the bellows spring 48, together with the orifice, is to limit the speed with which the magazine follower-ring 42 may push the RADs 30 forward, since as the spring lengthens, it must draw air inside to equalize air pressure. The orifice diameter thus controls the spring drive speed. The purpose of this design is to limit the impact with which each successive RAD 30 will stop at the first end 32 of the magazine 28. In one embodiment, the RADs 30 may be made of a semi rigid foam, and thus must be protected from impact deformation. Another reason for speed limitation is to allow for an automatic mode of RAD 30 launching, as described in more detail below.

In one embodiment, forward movement of the RADs 30 on the magazine 28 is limited by a stop. In one embodiment, the stop comprises a pair of primary magazine detents 50. As illustrated, the detents 50 comprise outwardly extending surfaces defined on a pair of opposing members. The primary detents 50 are thus located in opposing positions on the magazine tube 38.

In one embodiment, the magazine 28 includes a secondary stop in the form of secondary detents 54. In the embodiment illustrated, these secondary detents 54 are illustrated as wedge points. The secondary detents 54 are preferably located along the magazine 28 towards its second end 40, spaced from the primary detents 50 by the space occupied by one RAD 30. Thus, when loaded, the secondary detents 54 are located between a foremost and a second RAD.

In one embodiment, the secondary detents 54 are formed integrally with or on the member defining one of the opposing primary detents 50. Though the operation of the launcher 20 is described in more detail below, it will be appreciated that when a force is applied which causes the primary detents 50 to be pressed inwardly towards one another, the primary detents 50 move into a position in which a RAD 30 may move thereover along the magazine tube 38. In particular, in this position, the foremost RAD 30 may be pushed forward off of the magazine 28. At the same time, as the foremost RAD 30 moves forward, it causes the secondary detents 54 to be moved outward, inhibiting the next RAD 30 from moving forward.

Thus, in a preferred embodiment, the positions of the primary and secondary detents 50,54 are changeable. In one embodiment, this is accomplished by pivoting the member which defines the primary and secondary detents 50,54, or on which the primary and secondary detents 50,54 are located. As illustrated, each set of primary and secondary detents 50,54 is defined by a pivoting leg member. One end of the leg defines the secondary detent 54. A first end of the leg comprises a narrow or thin bridge 56 of material which allows for the leg to be moved with respect to the remainder of the magazine 28.

The launcher 20 includes a means for releasing a RAD 30 from the magazine 28 and a means for launching the released RAD 30. In one embodiment, the launcher 20 includes a user-operated mechanical trigger 58. As illustrated, the trigger 58 is a simple pinioned piece, which abuts, from the rear, a projection 60 of the magazine holder 23.

Means are provided for biasing the projection 60 rearwardly against the trigger 58. In one embodiment, this means comprises a torsion spring 62. As illustrated, the torsion spring 62 is located at an opposing end of the projection 60 from the trigger 58. The force of this spring 62 drives the magazine holder 23 rearward, forcing the trigger 58 to rotate counter clockwise until the back of the trigger tog is stopped by a frame wall 64 behind it. Oppositely, if a user presses upon the trigger 58, the magazine holder 23 is driven forward against the force of the spring 62.

As will be described in more detail below, forward movement of the magazine holder 23 as effected by depression of the trigger 58 causes a RAD 30 to be released from the magazine 28 and then to be launched from the launcher.

The launcher 20 includes means for propelling a RAD 30 through the passage or barrel 24. In one embodiment, this means comprises the drive disks 34*a,b*.

In one embodiment, means are provided for rotating the drive disks 34*a,b*. As described in more detail below, when the drive disks 34*a,b* are rotated and engage a RAD 30 which is removed from the magazine 28, spin and forward motion are imparted to the RAD 30.

In one embodiment, one or more batteries 66 are located in the grip-handle 26 of the launcher 20. One or more wires or leads extend from the batteries 66 to a switch S. As illustrated, the switch S is mounted to the wall 64, and is configured to be engaged by a tog 68 of the trigger 58. Preferably, the switch S is configured so that when the trigger 58 is pressed or squeezed and the tog 68 moves forward, the switch S closes by outward movement of a button, shown behind the tog 68.

The switch S controls a flow of current from the batteries 66 to a motor M. When the switch S is closed, a circuit from the batteries 66 to the motor M is completed, permitting current to flow to the motor M. As illustrated, the motor M is located in a compartment defined by the body or housing 22 of the launcher 20.

The motor M is an electric motor. Current flowing through motor M causes a shaft thereof to rotate. In one embodiment, the motor M is configured to rotate the drive disks 34*a,b*. As illustrated, each drive disk 34*a,b* is mounted upon a drive shaft 70*a,b*. The ends of the drive shafts 70*a,b* are mounted for rotation by one or more bearings B.

Figure 4:
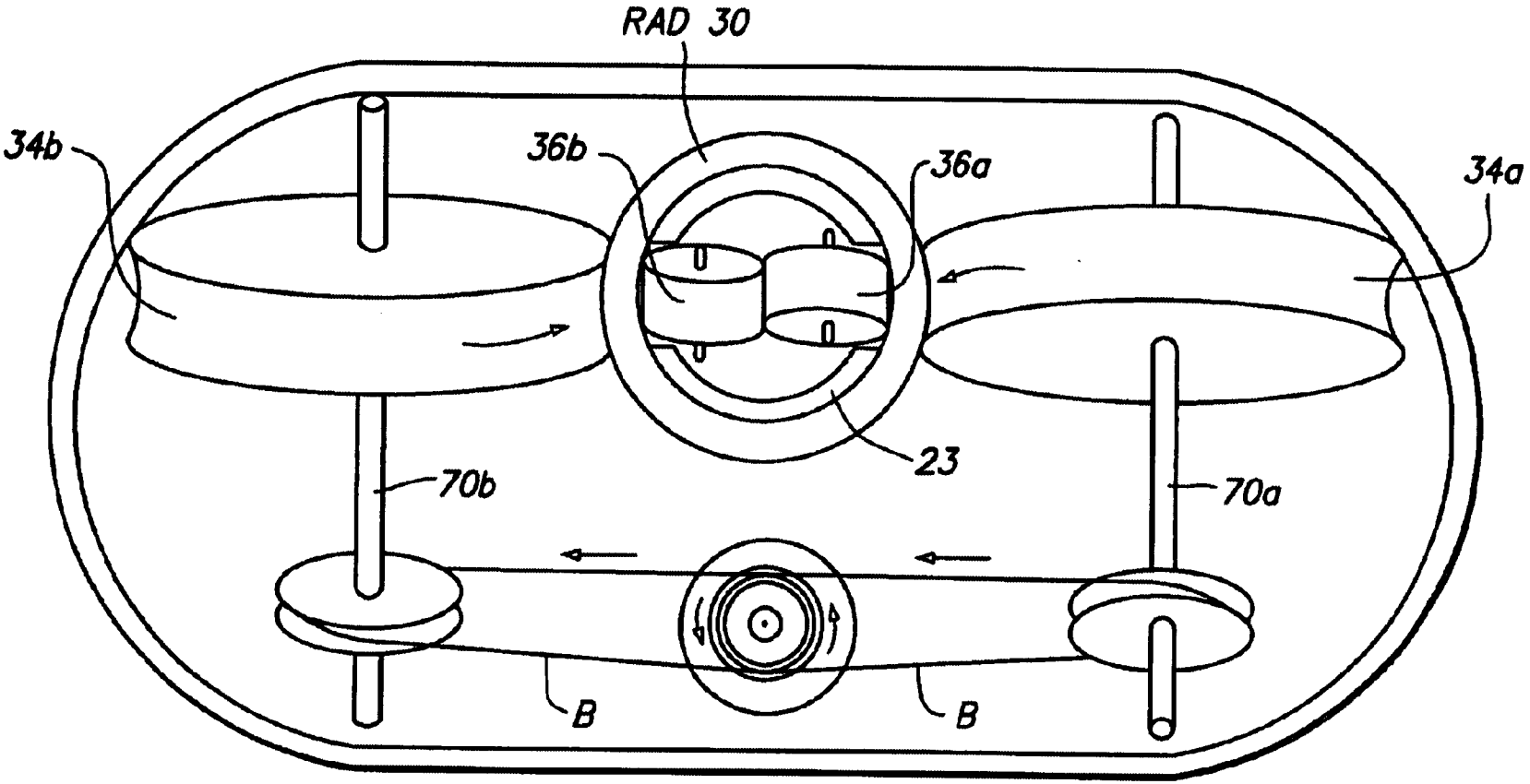
FIG. 4 is a perspective view of a drive mechanism of the launcher illustrated in FIG. 2.

Means are provided for rotating the drive shafts 70*a,b* with the motor M. As illustrated in FIGS. 2 and 4, in one embodiment, this means comprises a pulley/belt mechanism. In particular, a pulley 72 is mounted on each drive shaft 70*a,b*. A pair of pulleys 74 are mounted on the shaft of the motor M. A belt B (see FIG. 4) extends from each of the pulleys 74 on the motor shaft and the pulleys 72 on the drive shafts 70*a,b*.

Operation of the launcher 20 will now be described in more detail. Referring to FIG. 2, squeezing of the trigger 58 from its first or resting position to a second position causes the magazine holder 23 with attached magazine 28 to be moved forward a short distance. As illustrated in FIG. 4, when the magazine 28 is moved forward, its first end 34 moves into a location in which it is located between the drive disks 34*a,b*. Additionally, the drive disks 34*a,b* contact the follower wheels 36*a,b* of the magazine 38. It will be appreciated that at this time, the drive disks 34*a,b* will be spinning or rotating about their axis. As detailed above, this is because squeezing of the trigger 58 also causes switch S to close, providing current to the motor M, thus causing the shaft of the motor to drive the drive shafts 70*a,b*, and thus the drive disks 34*a,b*.

Contact of the follower wheels 36*a,b* with the rotating drive disks 34*a,b* causes the follower wheels 36*a,b* to rotate and to be pulled forward. As the follower wheels 36*a,b* are pulled forward between the drive disks 34*a,b*, the follower wheels 36*a,b* are pressed inwardly towards one another. In particular, the unbiased or resting position of the follower wheels 36*a,b* is preferably such that they occupy a greater space than the distance between the drive disks 34*a,b* at their closest point.

As illustrated, the follower wheels 36*a,b* are connected or mounted to the leg members which define the primary and secondary detents, or on which the primary and secondary detents are positioned. As such, the inward biasing or squeezing of the follower wheels 36*a,b* towards one another first causes the secondary detents 54*a,b* to move outwardly into a position in which they are interposed between the foremost and second RADs 30. Further inward movement causes the primary detents 50*a,b* to be moved out of engagement with the foremost RAD 30.

With the foremost RAD 30 now released for forward movement, further forward movement of the magazine 38 will cause the foremost RAD 30 to be caught by the drive disks 34*a,b* and to be rapidly accelerated by them as it is squeezed between them and the follower wheels 36*a,b*. In this manner, an axial propelling force is imparted to the RAD 30 for projecting the RAD 30 outwardly of the launcher 20 through the barrel 24 and along a further trajectory.

Importantly, spin is imparted to the RAD 30. In particular, as best illustrated in FIGS. 2 and 4, the drive disks 36*a,b* are canted or offset from vertical and horizontal. As such, the drive disks 36*a,b* each impart a horizontal force component to the RAD 30 which has the effect of rotating or spinning the RAD 30.

In one embodiment, the drive disks 36*a,b* are offset or canted from vertical by approximately ten degrees. This offset angle imparts upon the RAD a 0.176 spin to forward velocity ratio, deemed sufficient to confer gyroscopic stability to the RAD in flight. In one embodiment, the diameter of the drive disks 36*a,b* is about 2.8 inches. When rotated by the motor M at approximately 3600 rpm, the drive disks 36*a,b* are capable of accelerating the RAD to 44 feet per second.

As the RAD 30 moves through the barrel or passage 24, any chaotic motions experienced by the RAD 30 following its rapid acceleration will be dampened. As a result, when ejected from the launcher, the RAD 30 will fly true.

Once the trigger 58 is relaxed back to its first position and the RAD 30 has been launched, the magazine 38 will be moved slightly rearwardly. As this occurs, the follower wheels 36*a,b* and the members to which they are mounted are allowed to move outwardly. This outward movement causes the secondary detents 54*a,b* to move out of engagement with the next RAD 30, permitting the bellows spring 40 to move the follower 42, and thus that RAD 30, forward. The next RAD 30 is pressed forward until it engages the primary detents 50*a,b* and is stopped. The RAD 30 is then in position for launching, as described above, upon activation of the trigger 58.

In this arrangement, a plurality of RADs 30 may be associated with the launcher 20 and may be launched in succession. The launching occurs without the need to load an additional RAD 30 from an external source. In this regard, the launcher 20 may be appreciated to be a "multi-shot" launcher. In one embodiment, the magazine 28 may accept RADs 30 of different sizes.

The launcher 20 of the invention has additional advantages. One advantage is that each RAD 30 which is launched is imparted with both a forward velocity and a stabilizing spin. This has the effect of permitting the RAD 30 to fly far and near true or straight. In addition, projectiles other than ring airfoil shapes may also be launched. For example, the same or a modified magazine may load conventionally designed ballistic shaped projectiles for launching by the same or similar drive mechanism.

The launcher of the invention may be configured in other manners than that illustrated in FIGS. 2–4 and as just described. First, the components of the launcher 20 may have a variety of shapes and sizes and may be constructed of a variety of materials. In one embodiment, various of the components of the launcher 20, such as the body 22, may be constructed of a durable plastic material. Various components may be constructed of metals and other materials.

The various components of the launcher 20 may also be configured other than as specifically described or illustrated. For example, the means for biasing the RADs 30 on the magazine 28 may comprise other types of springs, air bladders or other devices. The follower 42 need not comprise a ring.

The trigger 58 may comprise a variety of other elements. For example, the trigger 58 may comprise a push-button or other means which is movable from a first to a second position. In one embodiment, the magazine 28/magazine holder 23 may be moved not by direct mechanical action, but by a motor or the like in response to the depression of the push-button.

The drive elements or other means for driving the RADs 30 may comprise other than the drive disks. For example, rotating belts or reciprocating sliders might be used. In one embodiment, the drive elements may be configured to impart only a propelling (i.e. longitudinal) force to the RADs 30, and not a spinning force.

In one embodiment, the magazine 28 need not be removable from the launcher 20. For example, in one embodiment, the second end of the magazine 28, including biasing means, may be disconnectable from the remainder of the magazine. The user may load the RADs 30 into the launcher 20 and then replace the second end of the magazine 28 along with the means for biasing, thus causing the RADs 30 to be biased forwardly.

In one embodiment, the means for biasing the RADs 30 might be mounted on the body 22 of the launcher 20 instead of the magazine 28.

The location of the various components of the launcher 20 may vary, as well. For example, the motor M may be mounted above the launch passage 24, as may be the batteries 66.

The drive disks may be rotated or drive in a variety of other fashions, and the means for imparting force upon the RADs may be different than just described.

In one embodiment, the motor M could be mounted directly on one of the drive disk shafts and directly drive that shaft. A pulley may be mounted on that driven shaft and the other shaft. A belt may be used to permit the drive pulley to rotate the driven pulley. In this embodiment, a one hundred sixty (160) degree twist mounted belt in this arrangement would impart the correct opposing rotation to the driven shaft. In this configuration, however, the rotational speeds of the drive disks can not be different from that of the motor.

Figure 5:
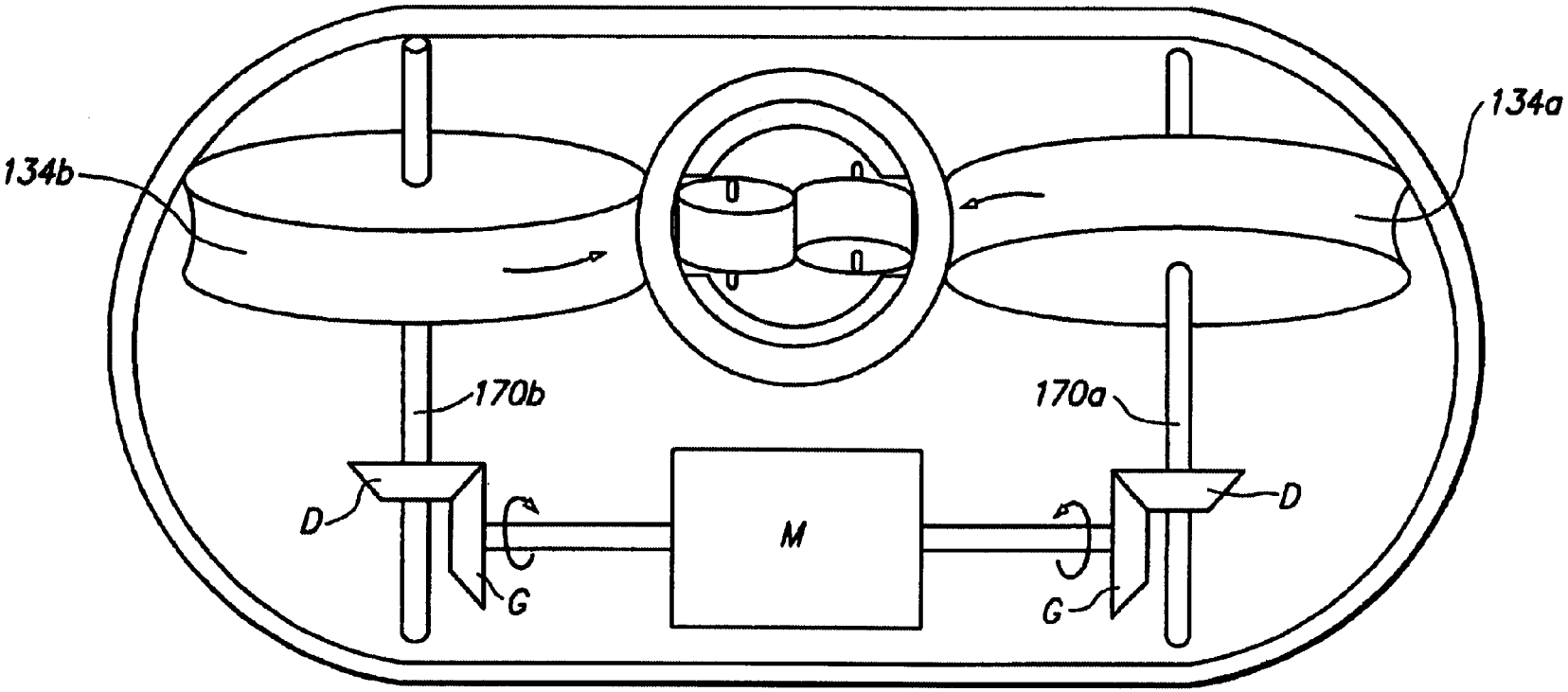
FIG. 5 is a perspective view of a drive mechanism in accordance with another embodiment of the invention.

As illustrated in FIG. 5, one means for rotating the drive disk shafts is through the use of gears. As illustrated, a centrally mounted motor M has a shaft protruding from both ends. A hypoid bevel gear G is mated to the ends of the shaft. These gears G are configured to drive mating driven gears D mounted on the drive shafts 170*a,b*. This arrangement has the advantage that the speed of rotation of each drive disk 134*a,b* may be independently selected, and may vary from one another, by selection of the gears.

In accordance with another embodiment, a more costly but robust way to spin the drive disks would be to mount a motor on each driver disk shaft. The independently spinning shafts should not differ in rpm by more than one percent for a good launch.

In accordance with another embodiment of the invention, the drive disks may be driven without mechanical connections. For example, the drive disks may be rotated with pressurized air, such as by directing the air stream at small turbines mounted on the driver disk shafts. The drive disks might also be rotated with springs or other devices.

It is also contemplated that the disks may be rotated without the use of an electric (or other) motor. For example, a hand pump or other user-operated mechanism may be used to effect rotation of the disks. For example, the launcher may include a pump which a user may move back and forth. The movement of the pump may cause one or more gears to be driven, which gears in turn drive the disks.

Figure 6:
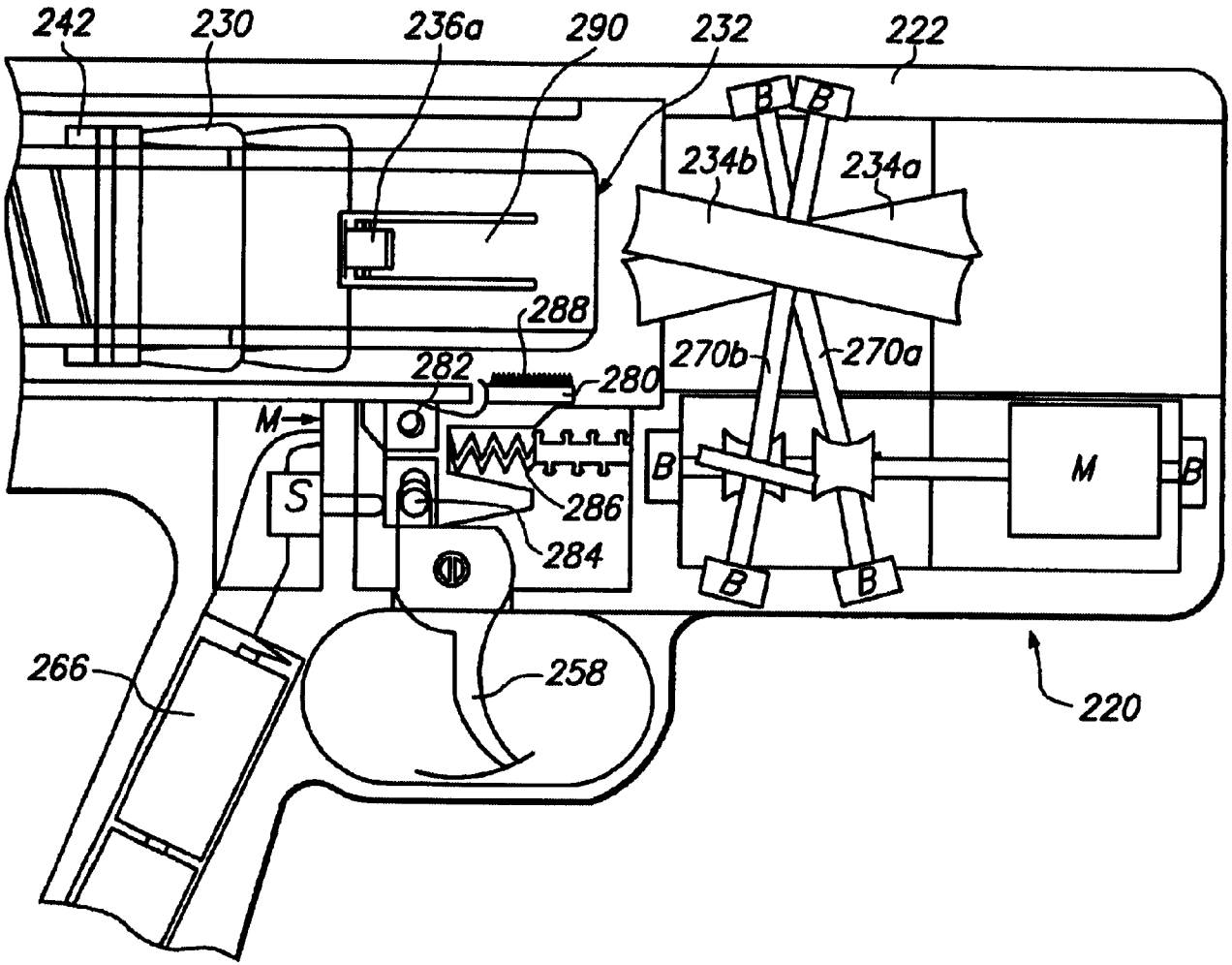
FIG. 6 is a cross-sectional side view of a portion of a launcher in accordance with another embodiment of the invention.

FIG. 6 is a partial view of a launcher 220 in accordance with another embodiment of the invention. In the description of this embodiment launcher 220, like reference numerals have been utilized to designate like parts to those of the embodiment launcher 20 described above, except that the pre-fix "2" has been added.

This embodiment launcher 220 includes a different means by which the drive disks 234*a,b* are driven. This embodiment launcher 220 is particularly suited for use in launching RADS which are stiffer, such as when constructed of a less pliable material. When considering the launcher 20 illustrated in FIG. 2, the use of such a stiffer RAD may cause it to jam between the follower wheels 136*a,b* and drive disks 134*a,b* if sufficient force can not be transmitted to the RAD.

In this embodiment launcher 220, the magazine 228 has no secondary detents, and the follower wheels 236*a,b* are smaller in diameter and are used to directly perform the function of the primary detents. The follower wheels 236*a,b* thus prevent the stacked RADs from moving forward on the cylindrical magazine body at one or more times.

In this embodiment, the function of the secondary detents is performed by an exterior stack retarder 280. As illustrated, the stack retarder 280 is pinioned to the magazine holder 223 over the trigger 258. As illustrated, the stack retarder 280 is connected to the magazine holder 223 by a pivot pin 282. Below this pivoting connection, the stack retarder 280 is connected to the trigger 258 by another pivot pin 284. The stack retarder 280 is also pressed upon by a coil spring 286. Finally, the stack retarder 280 is shown to have a cleated foot 288 oriented toward the stack of RADs on the magazine 228.

When using this embodiment launcher 220, squeezing the trigger 258 will first cause the stack retarder 280 to rotate counter-clockwise against the coil spring 286. This motion will bring the foot 288 of the stack retarder 280 into contact with the second RAD of the stack (when the magazine 228 is fully locked into the magazine holder 223—a situation that is not shown in FIG. 6 in order to better illustrate the launcher 220). The second RAD will be caught by the stack retarder 280 and will not be able to move forward along the magazine 228. As the trigger 258 is further pressed, the stack retarder 280, at the limit of its rotation, will force the magazine holder 223 and magazine 228 forward.

The drive disks 234*a,b*, previously set to spinning by initial trigger motion closing switch S as described above, will catch the foremost RAD and cause it to squeeze the magazine's small primary detent rollers 236*a,b* inward. Inward movement is permitted because the rollers 236*a,b* are mounted upon cantilevered supports 290. As in the previously described embodiments, the RAD is accelerated and spun as before. In this embodiment, however, the forces applied to opposing sides of the RAD are reduced.

It will be appreciated that the launcher of the invention has numerous advantages. First, the launcher is designed to launch ring airfoil projectiles. As indicated, these projectiles have numerous beneficial flight characteristics. In addition, the launcher is configured to impart both a significant propelling force to the ring airfoil projectile and a stabilizing spinning force. As a result, the ring airfoil projectile flies far and near straight or true.

Another advantage of the invention is that the launcher is configured to launch multiple ring airfoil projectiles without the need to reload. As described, multiple ring airfoil projectiles may be loaded at one time and then be sequentially launched.

Another advantage of the invention is that the launcher is "motorized." As will be appreciated, there are a number of ways to impart a force upon the ring airfoil devices for launching them. For example, a spring force might be applied, such as through a launch body, to the ring airfoil projectile. In the preferred embodiment, however, the force is applied by a motorized or motor-driven drive element. It will be appreciated that this configuration permits a great amount of energy to be imparted to the ring airfoil projectile, causing it to fly far and near straight.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. A launcher capable of launching in succession at least two ring airfoil projectiles comprising:

a body, said body defining a launch passage, said passage having a first end and a second end;

magazine on which a plurality of ring airfoil projectiles may be located, said magazine configured to be inserted into said first end of launch passage;

at least one drive element, at least a portion of said at least one drive element engaging at one or more times a ring airfoil projectile on said magazine;

a drive adapted to rotate said at least one drive element, whereby when said at least one drive element contacts said ring airfoil projectile, said ring airfoil projectile is propelled forward off of said magazine through said launch passage towards said second end and is propelled from said launcher; and a trigger, said trigger movable from a first position to a second position, said trigger when moved to said second position causing said magazine to move forward so that said at least one drive element engages said ring airfoil projectile.

2. The launcher in accordance with claim 1 including a magazine housing located at least partially with said launch passage, said magazine connectable to said magazine housing.

3. The launcher in accordance with claim 1 wherein said magazine has a first end and a second end and means for biasing said ring airfoil projectiles towards said first end.

4. The launcher in accordance with claim 3 wherein said means comprises a bellows-type spring.

5. The launcher in accordance with claim 3 including at least one stop for selectively preventing said ring airfoil projectiles from being removed from said magazine at said first end.

6. The launcher in accordance with claim 5 wherein said at least one stop comprises a first detent extending from a pivoting member, said member movable from a first position, in which said first detent extends outwardly to engage a ring airfoil projectile, and a second position, in which said first detent is pressed inwardly, permitting said ring airfoil projectile to move off of said first end of said magazine.

7. The launcher in accordance with claim 6 including a second detent extending from said member, said second detent configured to engage a subsequent ring airfoil projectile mounted on said magazine.

8. The launcher in accordance with claim 5 wherein at least one wheel is mounted to said member, wherein when said magazine is moved forward said drive element engages said wheel, pressing said member inwardly to said position where said first detent is not in engagement with said ring airfoil projectile.

9. The launcher in accordance with claim 1 wherein said drive comprises a motor.

10. The launcher in accordance with claim 9 wherein said drive element comprises a disk, said disk connected to a drive shaft, said motor driving said drive shaft.

11. The launcher in accordance with claim 10 wherein a first gear on said motor engages a second gear on said drive shaft.

12. The launcher in accordance with claim 1 wherein said drive element comprises a pair of drive disks, said drive disks configured to engage opposing sides of said ring airfoil projectile.

13. The launcher in accordance with claim 12 wherein said drive disks are canted with respect to one another and to an axis extending through said launch passage, whereby said drive disks impart a spinning motion upon said ring airfoil projectile.

14. The launcher in accordance with claim 1 wherein said drive element comprises a pair of drive disks rotatable by an electric motor and wherein said magazine is mounted to a magazine holder slidably positioned in said launch passage, said trigger when moved to said second position moving a switch to a position in which current flows from a power source to said motor, causing said drive disks to be rotated, and causing said magazine holder to move forward, causing said ring airfoil projectile to be engaged by said drive disks.

15. A method of launching a plurality of ring airfoil projectiles with a launcher comprising:

loading at least a first and a second ring airfoil projectile on a magazine, said magazine having a first end and a second end;

inserting said first end of said magazine into a first end of a passage through said launcher;

biasing said ring airfoil projectiles towards said first end of said magazine;

stopping said ring airfoil projectiles from being removed from said first end of said magazine;

accepting a trigger input and in response thereto:

moving said magazine forward towards said second end of said passage;

rotating a pair of drive disks;

releasing said first ring airfoil projectile from said magazine;

stopping said second ring airfoil projectile on said magazine;

engaging said rotating drive disks with said released first ring airfoil projectile; and propelling said first ring airfoil projectile from said second end of said passage.

16. The method in accordance with claim 15 wherein said stopping step comprises moving a pair of opposing stops outwardly into the path of said ring airfoil projectiles.

17. The method in accordance with claim 15 wherein said step of rotating comprises activating a motor connected to said drive disks in a driving relationship.

18. The method in accordance with claim 15 wherein said magazine is mounted to a magazine holder and said step of moving said magazine comprises the step of moving said magazine holder.

19. The method in accordance with claim 15 wherein said step of stopping said second ring airfoil projectile comprises moving a pair of detents outwardly in front of said second ring airfoil projectile.

20. The method in accordance with claim 15 wherein said step of stopping said first and second ring airfoil projectiles comprises moving a pair of detents outwardly in front of said first ring airfoil projectile.

* * * * *